US009486060B1

(12) United States Patent
Cara

(10) Patent No.: US 9,486,060 B1
(45) Date of Patent: Nov. 8, 2016

(54) PAINT BRUSH SYSTEM

(71) Applicant: Shkelqim Cara, Dunedin, FL (US)

(72) Inventor: Shkelqim Cara, Dunedin, FL (US)

( * ) Notice: Subject to any disclaimer, the term of this patent is extended or adjusted under 35 U.S.C. 154(b) by 0 days.

(21) Appl. No.: 14/811,322

(22) Filed: Jul. 28, 2015

Related U.S. Application Data

(63) Continuation-in-part of application No. 14/121,691, filed on Oct. 9, 2014, now abandoned.

(51) Int. Cl.
*A46B 5/00* (2006.01)
*B25G 1/06* (2006.01)

(52) U.S. Cl.
CPC ..... *A46B 5/0079* (2013.01); *A46B 5/0058* (2013.01); *A46B 5/0083* (2013.01); *B25G 1/06* (2013.01)

(58) Field of Classification Search
CPC . A46B 5/0058; A46B 5/0083; A46B 5/0079
See application file for complete search history.

(56) References Cited

U.S. PATENT DOCUMENTS 1,649,951 A * 11/1927 English ..... B25G 3/38 403/147
4,528,714 A * 7/1985 Beck ..... B05C 17/022 15/144.1
5,207,755 A * 5/1993 Ampian ..... A46B 5/0075 15/144.1
8,132,978 B2 * 3/2012 Franklin ..... B05C 17/022 16/324
2006/0123578 A1 * 6/2006 Rickstrew ..... B05C 17/0205 15/230.11

* cited by examiner

*Primary Examiner* — Randall Chin

(57) ABSTRACT

A paint brush system. A lower component has a handle with an axis and a lower disk. The lower disk has interior and exterior surfaces. The axis of the lower disk is at a right angle with respect to the axis of the handle. An upper component has a base with bristles in a bristle plane. The upper component has an upper disk with interior and exterior surfaces. The axis of the upper disk is at a right angle with respect to the axis of the base. An adjustment assembly is intermediate the upper and lower components. The adjustment assembly includes teeth projecting axially outwardly from one of the disks. An annular surface is radially exterior of the teeth. The adjustment assembly includes recesses projecting axially inwardly from the other disk. An annular surface is radially exterior of the recesses.

1 Claim, 4 Drawing Sheets

PAINT BRUSH SYSTEM

RELATED APPLICATION

The present application is a continuation-in-part of application Ser. No. 14/121,691, filed Oct. 9, 2014, now abandoned, the subject matter of which is incorporated herein by reference.

BACKGROUND OF THE INVENTION

Field of the Invention

The present invention relates to a paint brush system and more particularly pertains to a handle adapted to be held by a painter during use, the holding of the handle and varying of the angle being done in a safe, convenient, clean, and economical manner.

SUMMARY OF THE INVENTION

In view of the foregoing disadvantages inherent in the types of brush systems of known design and configurations now present in the prior art, the present invention provides an improved paint brush system. As such, the general purpose of the present invention, which will be described subsequently in greater detail, is to provide a new and improved paint brush system and method which has all the advantages of the prior art and none of the disadvantages.

From a broad viewpoint, the present invention is a paint brush system. A lower component is provided. The lower component has a handle with an axis. The lower component has a lower disk with an exterior surface and an interior surface. The axis of the lower disk is at a right angle with respect to the axis of the handle.

An upper component is provided. The upper component has a base with bristles in a bristle plane. The base has an axis. The upper component has an upper disk with an exterior surface and an interior surface. The axis of the upper disk is at a right angle with respect to the axis of the base.

An adjustment assembly is provided intermediate the upper and lower components. Teeth project axially outwardly from one of the disks. An annular surface is provided radially exterior of the teeth. The adjustment assembly also includes recesses projecting axially inwardly from the other disk. An annular surface is provided radially exterior of the recesses.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint brush system which has all of the advantages of the prior art brush systems of known designs and configurations and none of the disadvantages.

It is another object of the present invention to provide a new and improved paint brush system which may be easily and efficiently manufactured and marketed.

It is a further object of the present invention to provide a new and improved paint brush system which is of durable and reliable constructions.

An even further object of the present invention is to provide a new and improved paint brush system which is susceptible of a low cost of manufacture with regard to both materials and labor, and which accordingly is then susceptible of low prices of sale to the consuming public, thereby making such paint brush system economically available to the buying public.

Lastly, another object of the present invention is to provide a paint brush system for adapting a handle to be held by a painter during use, the holding of the handle and varying of the angle being done in a safe, convenient, clean, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
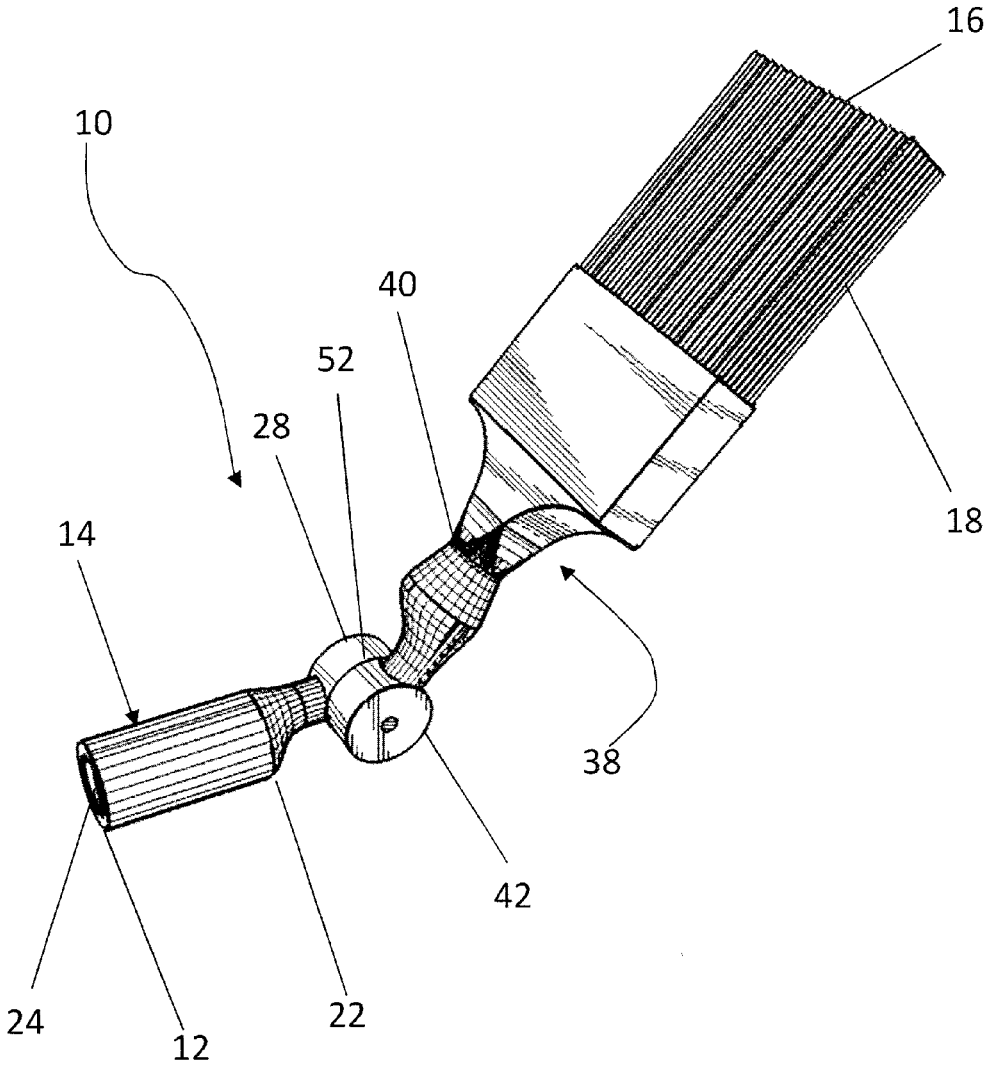
FIG. 1 is a perspective illustration of a paint brush system constructed in accordance with the principles of the present invention.
Figure 2:
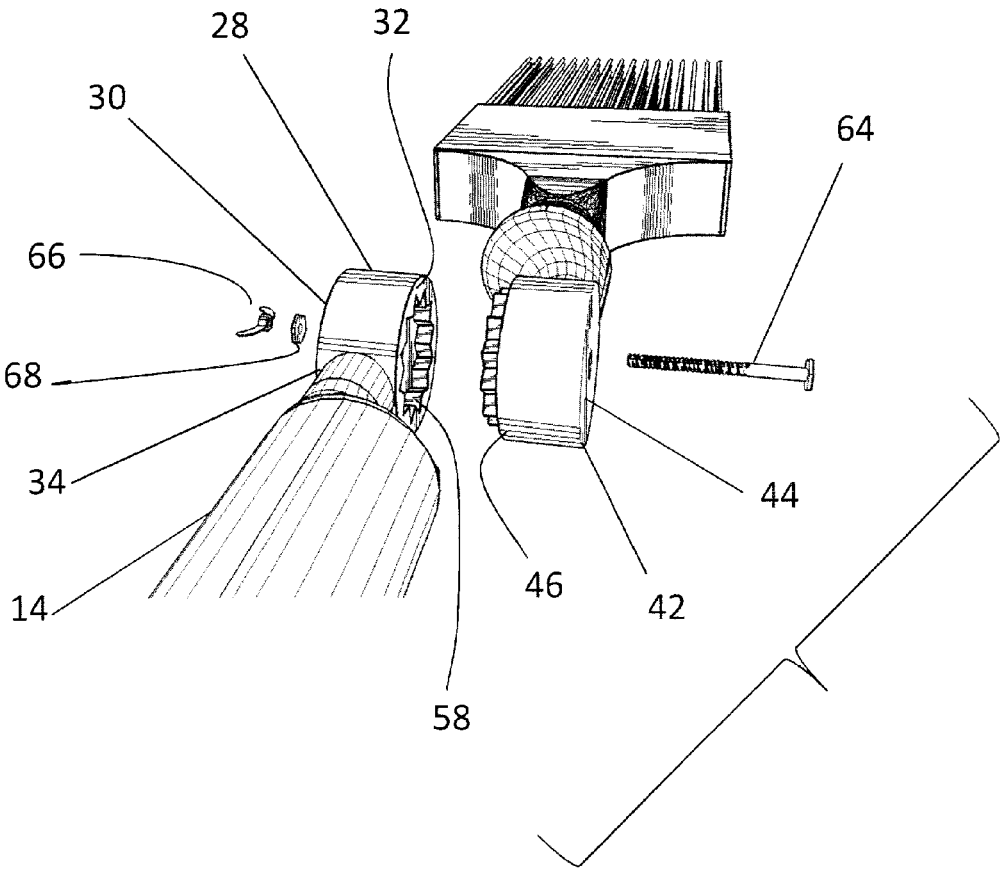
FIG. 2 is an exploded perspective illustration of the paint brush system shown in FIG. 1.
Figure 3:
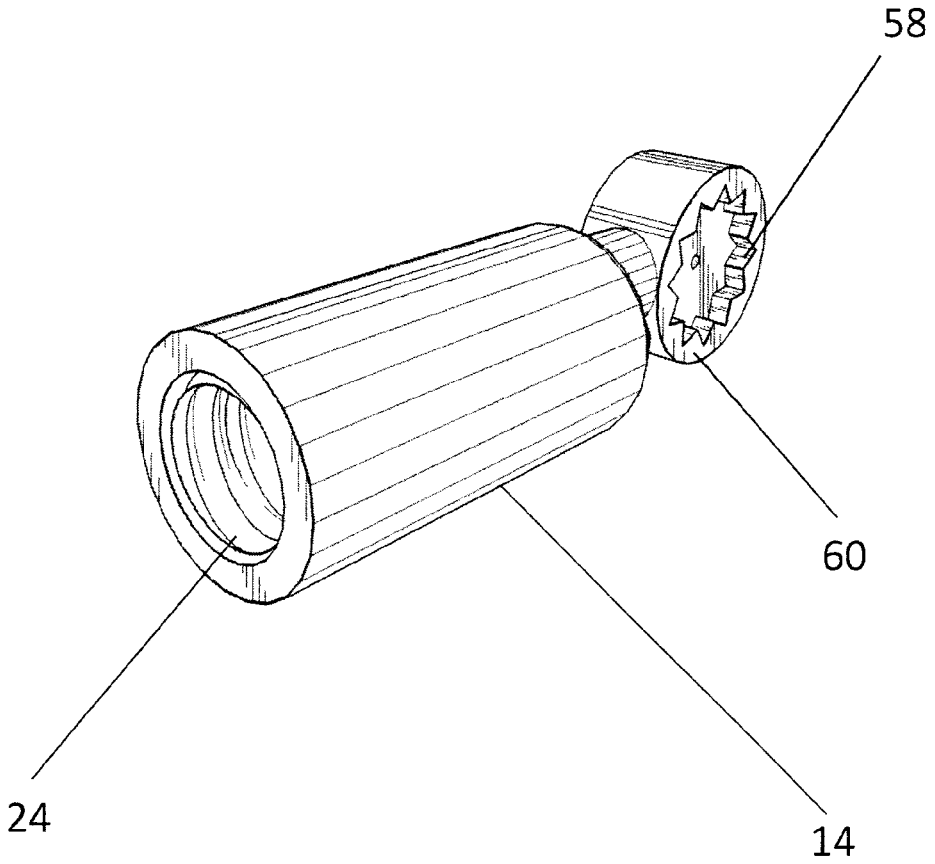
FIG. 3 is a perspective illustration of the upper component shown in FIGS. 1 and 2.
Figure 4:
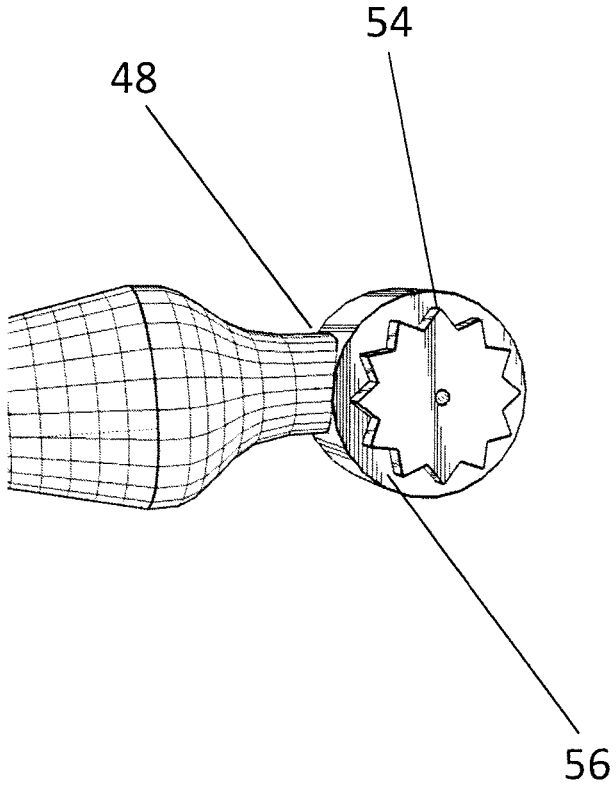
FIG. 4 is a perspective illustration of the lower component shown in FIGS. 1 and 2.

With reference now to the drawings, and in particular to FIG. 1 thereof, the preferred embodiment of the new and improved paint brush system embodying the principles and concepts of the present invention and generally designated by the reference numeral 10 will be described.

The present invention, the paint brush system 10 is comprised of a plurality of components. Such components in their broadest context include a lower component, an upper component, and an adjustment assembly. Such components are individually configured and correlated with respect to each other so as to attain the desired objective.

From a specific viewpoint, the present invention is a paint brush system. The paint brush system has a lower end 12 with a cylindrical handle 14. In this manner, the cylindrical handle is adapted to be held by a painter during use. The system has an upper end 16 with bristles 18 wherein an angle between the handle and the bristles is adapted to be varied prior to use. A lower component 22 is provided. The lower component has a cylindrical handle 14. The cylindrical handle is adjacent to the lower end of the system. The cylindrical handle has a threaded aperture 24. The threaded aperture extends upwardly into the cylindrical handle from the lower end of the system. The threaded aperture is adapted to threadedly receive a threaded end of a conventional pole. In this manner painting at elevated locations is facilitated. The lower component has a first cylindrical disk 28. The first cylindrical disk has a first exterior surface 30. The first cylindrical disk has a first interior surface 32. The lower component has a first cylindrical coupler 34. In this manner, the cylindrical handle is joined to the first cylindrical disk. The cylindrical handle has a first diameter. The cylindrical handle has a first central axis. The first cylindrical disk has a second diameter. The first cylindrical disk has a second central axis. The first cylindrical coupler has a third diameter. The first cylindrical coupler has a third central axis. The third diameter is less than the first diameter. The third central axis is provided parallel with and laterally offset from the first central axis. The second diameter is equal to the first diameter. The second central axis is provided at a right angle with respect to both the first central axis and the third central axis.

Further provided is an upper component 38. The upper component has a cylindrical base 40. The upper component has bristles 18. The bristles are provided adjacent to the upper end 16 of the system. The bristles are provided in a bristle plane. The upper component has a second cylindrical disk 42. The second cylindrical disk has a second exterior surface 44. The second cylindrical disk has a second interior surface 46. The upper component has a second cylindrical coupler 48. In this manner the bristles and the second cylindrical disk are joined. The cylindrical base has a fourth diameter. The cylindrical base has a fourth central axis. The second cylindrical disk has a fifth diameter. The cylindrical disk has a fifth central axis. The second cylindrical coupler has a sixth diameter. The second cylindrical coupler has a sixth central axis. The sixth diameter is less than the fourth diameter. The sixth central axis is provided parallel with and laterally offset from the fourth central axis. The fifth diameter is less than the fourth diameter. The fifth central axis is provided at a right angle with respect to both the fourth central axis and the sixth central axis.

Provided last is an adjustment assembly 52. The adjustment assembly is provided intermediate the upper component and the lower component. The adjustment assembly includes triangular recesses 58. The triangular recesses project axially outwardly from the first interior surface of the first cylindrical disk. The adjustment assembly has an annular first surface 60. The annular first surface is planar in configuration. The annular first surface is provided radially exterior of the triangular recesses. The adjustment assembly includes triangular teeth 54. The triangular teeth extend axially inwardly from the second interior surface of the second cylindrical disk. The adjustment assembly has an annular second surface 56. The annular second surface is planar in configuration. The annular second surface is provided radially exterior of the triangular teeth. An aperture is provided. The aperture extends through the first cylindrical disk and the second cylindrical disk. The aperture is coaxial with the second central axis and the fifth central axis. A bolt 64 is provided. The bolt extends through the aperture. A wing nut 66 is provided. A washer 68 is provided. In this manner the first cylindrical disk and second cylindrical disk are held together. Triangular teeth are provided. The triangular teeth are provided within the triangular recesses at any of a plurality of rotational orientations. In this manner a washer-shaped plane is formed between the annular first surface and the annular second surface. Also in this manner paint is abated from coming between the first cylindrical disk and the second cylindrical disk. The second central axis and the and fifth central axis are in the bristle plane. Further in this manner, forces on the triangular teeth and the triangular recesses are rotational rather than axial during use of the system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint brush system (10) comprising:

a lower component (22) having a cylindrical handle (14) adjacent to the lower end of the system, the cylindrical handle having a threaded aperture (24) extending upwardly into the cylindrical handle from the lower end of the system, the threaded aperture adapted to threadedly receive a threaded end of a conventional pole for painting at elevated locations, the lower component having a first cylindrical disk (28) with a first exterior surface (30) and a first interior surface (32), the lower component having a first cylindrical coupler (34) joining the cylindrical handle and the first cylindrical disk, the cylindrical handle having a first diameter and a first central axis, the first cylindrical disk having a second diameter and a second central axis, the first cylindrical coupler having a third diameter and a third central axis, the third diameter being less than the first diameter, the third central axis being parallel with and laterally offset from the first central axis, the second diameter being equal to the first diameter, the second central axis being at a right angle with respect to both the first central axis and the third central axis;

an upper component (38) having a cylindrical base (40) and with bristles (18) adjacent to the upper end (16) of the system, the bristles being in a bristle plane, the upper component having a second cylindrical disk (42) with a second exterior surface 44 and a second interior surface (46), the upper component having a second cylindrical coupler (48) joining the bristles and the second cylindrical disk, the cylindrical base having a fourth diameter and a fourth central axis, the second cylindrical disk having a fifth diameter and a fifth central axis, the second cylindrical coupler having a sixth diameter and a sixth central axis, the sixth diameter being less than the fourth diameter, the sixth central axis being parallel with and laterally offset from the fourth central axis, the fifth diameter being less than the fourth diameter, the fifth central axis being at a right angle with respect to both the fourth central axis and the sixth central axis; and an adjustment assembly (52) intermediate the upper component and the lower component, the adjustment assembly including triangular recesses (58) projecting axially outwardly from the first interior surface of the first cylindrical disk, an annular first surface (60) in a planar configuration radially exterior of the triangular recesses, the adjustment assembly including triangular teeth (54) extending axially inwardly from the second interior surface of the second cylindrical disk, an annular second surface (56) in a planar configuration radially exterior of the triangular teeth, an aperture extending through the first cylindrical disk and the second cylindrical disk, the aperture being coaxial with the second central axis and the fifth central axis, a bolt (64) extending through the aperture, a wing nut (66) with a washer (68) holding together the first cylindrical disk and second cylindrical disk with the triangular teeth within the triangular recesses at any of a plurality of rotational orientations and also forming a washer-shaped plane between the annular first surface and the annular second surface to abate paint coming between the first cylindrical disk and the second cylindrical disk, the second central axis and the fifth central axis being in the bristle plane whereby forces on the triangular teeth and the triangular recesses are rotational rather than axial during use of the system.

* * * * *